US008144906B2

(12) United States Patent
Daley et al.

(10) Patent No.: US 8,144,906 B2
(45) Date of Patent: Mar. 27, 2012

(54) WIND IMMUNE MICROPHONE

(75) Inventors: Michael James Daley, Canonsburg, PA (US); Andrew Jonathan Doller, Pittsburgh, PA (US); Todd Martin Keebler, Pittsburgh, PA (US)

(73) Assignee: Akustica, Inc., Pittsburgh, PA (US)

( * ) Notice: Subject to any disclaimer, the term of this patent is extended or adjusted under 35 U.S.C. 154(b) by 620 days.

(21) Appl. No.: 12/314,609

(22) Filed: Dec. 12, 2008

(65) Prior Publication Data

US 2009/0290741 A1 Nov. 26, 2009

Related U.S. Application Data

(60) Provisional application No. 61/071,855, filed on May 21, 2008.

(51) Int. Cl.
*H04R 25/00* (2006.01)
*H04R 9/08* (2006.01)
*G10K 11/16* (2006.01)

(52) U.S. Cl. ..... 381/322; 381/71.1; 381/71.4; 381/71.7; 381/71.8; 381/335; 381/337; 381/345; 381/348; 381/355

(58) Field of Classification Search ..... 381/322, 381/335, 337, 345, 347, 348, 355, 71.1, 71.4, 381/71.7, 71.8
See application file for complete search history.

(56) References Cited

U.S. PATENT DOCUMENTS

| | | | | |
|---|---|---|---|---|
| 3,646,281 | A | 2/1972 | McGunigle | 179/111 R |
| 4,117,275 | A | 9/1978 | Miyanaga et al. | 179/111 E |
| 4,263,484 | A | 4/1981 | Hisatsune et al. | |
| 5,740,262 | A | 4/1998 | Yoshida et al. | |
| 5,870,482 | A | 2/1999 | Loeppert et al. | |
| 6,169,811 | B1 * | 1/2001 | Croft, III | 381/186 |
| 7,346,179 | B1 | 3/2008 | Bobisuthi et al. | 381/355 |
| 2004/0146810 | A1 | 7/2004 | Gabriel et al. | |
| 2008/0130934 | A1 | 6/2008 | Bobisuthi et al. | 381/356 |
| 2010/0027817 | A1 | 2/2010 | Dyer et al. | |

OTHER PUBLICATIONS

International Search Report, PCT/US2009/044866, dated Oct. 26, 2009.

* cited by examiner

*Primary Examiner* — Long Tran
(74) *Attorney, Agent, or Firm* — Kenyon & Kenyon LLP

(57) ABSTRACT

Disclosed is an acoustic device comprising an enclosed housing defining an inner volume and having a front and a back; an acoustic port penetrating the front of the enclosed housing; a first and second sense structure attached to the inside of the housing and defining a gap between the first and second sense structures; a front volume defined by the portion of the inner volume between the first sense structure and the front of the housing; a back volume defined by the portion of the inner volume between the second sense structure and the back of the housing; and at least one vent in the first sense structure operatively connecting the front volume and the gap, wherein the acoustic device has a cutoff frequency above approximately 100 Hz.

17 Claims, 16 Drawing Sheets

WIND IMMUNE MICROPHONE

This application claims the benefit of U.S. Provisional Application Ser. No. 61/071,855, filed on May 21, 2008, which is expressly incorporated by reference herein.

FIELD OF THE INVENTION

The present invention relates to microphones and sensors resistant to low frequency noise.

DISCUSSION OF THE RELATED ART

Microphones and acoustic sensors (hereinafter generically referred to as microphones) are frequently used in noisy environments. As microphones become smaller, the transduced low frequency noise content of air flow, wind, moving vehicles, accoustic rumble, or other low frequency sources can be larger than the desired acoustic signal. This may make the microphone difficult to use in outdoor, windy, or other noisy environments.

Some microphones have an external package housing with a flexible sense structure such as a diaphragm, a stationary sense structure (such as a condenser microphone backplate or an electrodynamic microphone magnet), internal electronic components, at least one volume of air, and at least one pressure equalization vent. The pressure equalization vent equalizes changes in static atmospheric pressure on opposite sides of the diaphragm. The vent may also match the ambient pressure outside the microphone with the air pressure in one or more of the air volumes within the microphone.

Typically, a microphone vent is designed to ensure that the microphone responds to frequencies as low as 20 Hz or lower. In these microphones, the vent connects the air outside the housing to the air in the back volume. Alternatively, the vent penetrates the microphone diaphragm to connect the air inside the front volume to the air inside the back volume, or the air inside the front volume to the air inside the gap. As these vents may reduce microphone sensitivity to low audio frequencies, the vents are designed to minimize sensitivity reduction in the audio frequency band. The geometric and fluid characteristics of the vent may be designed to ensure that the highpass filter corner frequency does not substantially alter the frequency response in the frequency band of interest. This design makes the microphone susceptible to wind and other low frequency noise.

SUMMARY OF THE INVENTION

Accordingly, the present invention is directed to a wind immune microphone (i.e., immune or resistant to wind noise) or an acoustic device resistant to noise generated by air flow, wind, moving vehicles, acoustic rumble, or other low frequency sources.

In one embodiment, the present invention provides an acoustic device having a reduced audible output of low frequency wind noise and acoustic rumble.

In another embodiment, the present invention provides an acoustic device having a reduced deflection of the diaphragm from wind and low frequency noise.

In yet another embodiment, the present invention provides an acoustic device having a diaphragm with increased resistance to diaphragm collapse from combined electrostatic and pressure load.

In still another embodiment, the present invention provides an acoustic device with a reduced need for electronic filtering of low frequency output of the sensor.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages in accordance with the present invention, as embodied and broadly described, an embodiment of the wind immune microphone provides an acoustic device including an enclosed housing defining an inner volume and having a front and a back, an acoustic port penetrating the front of the housing, a first and second sense structure attached to the inside of the housing and defining a gap between the first and second sense structures, a front volume defined by the portion of the inner volume between the first sense structure and the front of the housing, a back volume defined by the portion of the inner volume between the second sense structure and the back of the housing, and at least one vent in the first sense structure operatively connecting the front volume and the gap, wherein the acoustic device has a cutoff frequency above approximately 100 Hz.

In another embodiment, an acoustic device includes an enclosed housing defining an inner volume and having a front and a back, an acoustic port penetrating the front of the housing, a support structure attached to the inside of the housing, a first sense structure attached to the support structure, a second sense structure attached to the inside of the housing, the first and second sense structures defining a gap between the first and second sense structures, a front volume defined by the portion of the inner volume between the first sense structure and the front of the housing, a back volume defined by the portion of the inner volume between the second sense structure and the back of the housing, and at least one vent in the support structure, the at least one vent operatively connecting the front volume and the gap, wherein the acoustic device has a cutoff frequency above approximately 100 Hz.

Yet another embodiment includes an acoustic device having an enclosed housing defining an inner volume and having a front and a back, an acoustic port penetrating the front of the housing, a support structure attached to the inside of the housing, a first and second sense structure attached to the support structure and defining a gap between the first and second sense structures, a front volume defined by the portion of the inner volume between the first sense structure and the front of the housing, a back volume defined by the portion of the inner volume between the second sense structure and the back of the housing, and at least one vent in the support structure, the at least one vent operatively connecting the front and back volumes, wherein the acoustic device has a cutoff frequency above approximately 100 Hz.

Still another aspect of the acoustic device includes an enclosed housing defining an inner volume and having a front and a back, an acoustic port penetrating the front of the housing, a first and second sense structure attached to the inside of the housing and defining a gap between the first and second sense structures, a front volume defined by the portion of the inner volume between the first sense structure and the front of the housing, a back volume defined by the portion of the inner volume between the second sense structure and the back of the housing, and at least one vent in the second sense structure operatively connecting the back volume and the gap, wherein the acoustic device has a cutoff frequency above approximately 100 Hz.

In a further aspect of the invention, a method of forming an acoustic device includes the steps of forming an enclosed housing defining an inner volume and having a front and a back, forming an acoustic port penetrating the front of the housing, attaching a diaphragm having a compliance $C_d$ to the inside of the housing, the diaphragm dividing the inner volume into a front volume and a back volume, the back volume having a compliance $C_v$, forming at least one vent in the diaphragm, the vent having an acoustic resistance $R_1$, and setting $C_d$, $C_v$, and $R_1$ to non-zero values such that the acoustic device has a cutoff frequency $f_c$ of approximately 100 Hertz or greater, with $f_c$ defined by the equation $$f_c \approx \frac{1}{2\pi R_l(C_d + C_v)}.$$

In still another aspect of the invention, a method of forming an acoustic device includes the steps of forming an enclosed housing defining an inner volume and having a front and a back, forming an acoustic port penetrating the front of the housing, attaching a support structure to the inside of the housing, attaching a diaphragm having a compliance $C_d$ to the inside of the support structure, the diaphragm dividing the inner volume into a front volume and a back volume, the back volume having a compliance $C_v$, forming at least one vent connecting the front volume to the back volume, the vent having an acoustic resistance $R_1$, and setting $C_d$, $C_v$, and $R_1$ to non-zero values such that the acoustic device has a cutoff frequency $f_c$ of approximately 100 Hertz or greater, with $f_c$ defined by the equation $$f_c \approx \frac{1}{2\pi R_l(C_d + C_v)}.$$

It is to be understood that both the foregoing general description and the following detailed description are exemplary and explanatory and are intended to provide further explanation of the invention as claimed. For example, in each of the foregoing descriptions, the front volume may be reduced or eliminated, such that a vent formerly connecting the front volume to the gap or back volume would instead connect the fluid external to the housing to the gap or back volume, respectively without affecting the wind immunity of the device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the embodiments of the present invention, examples of which are illustrated in the accompanying drawings. Wherever possible, like reference numbers will be used for like elements.

Figure 1:
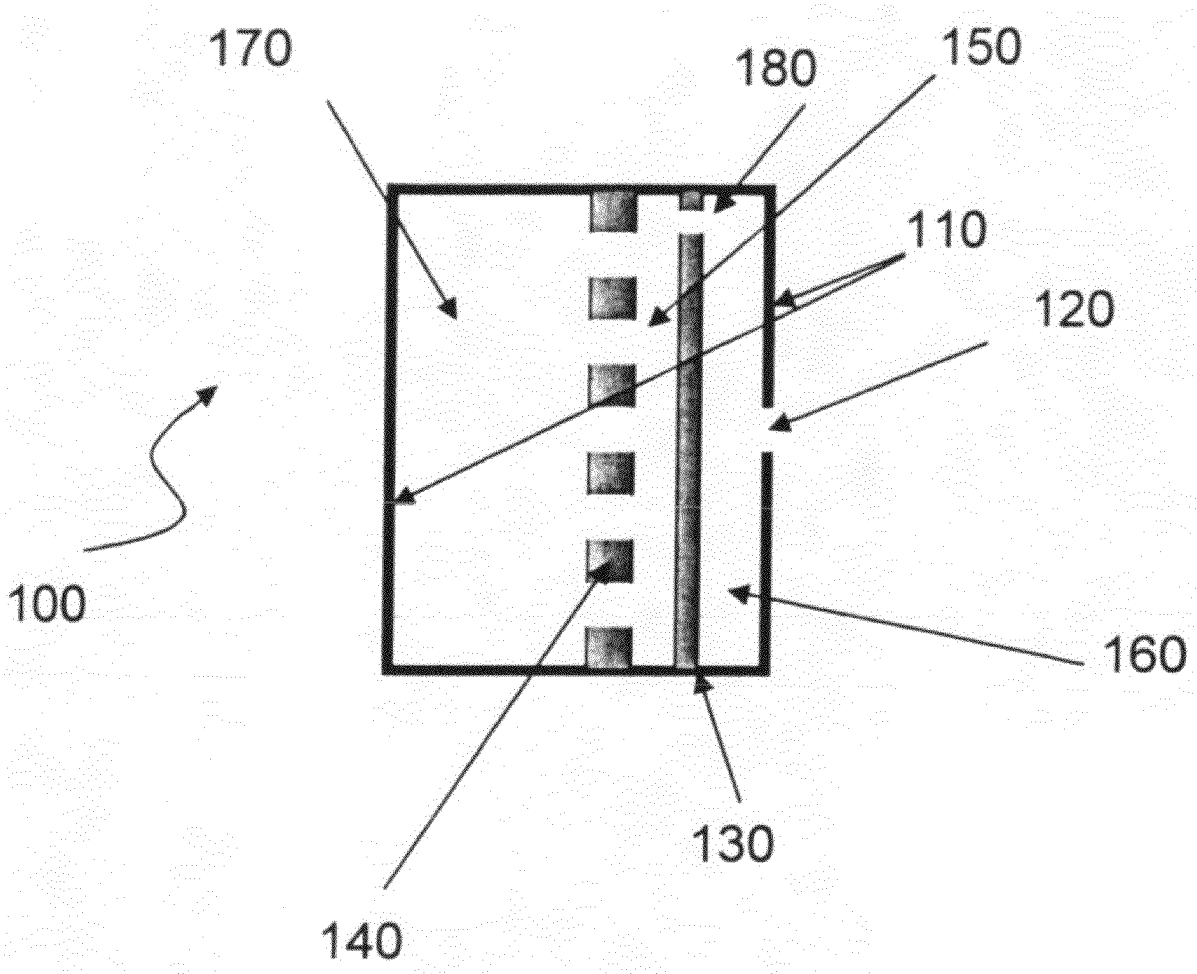
FIG. 1 is a schematic diagram of a condenser microphone construction with a vented diaphragm.
Figure 2:
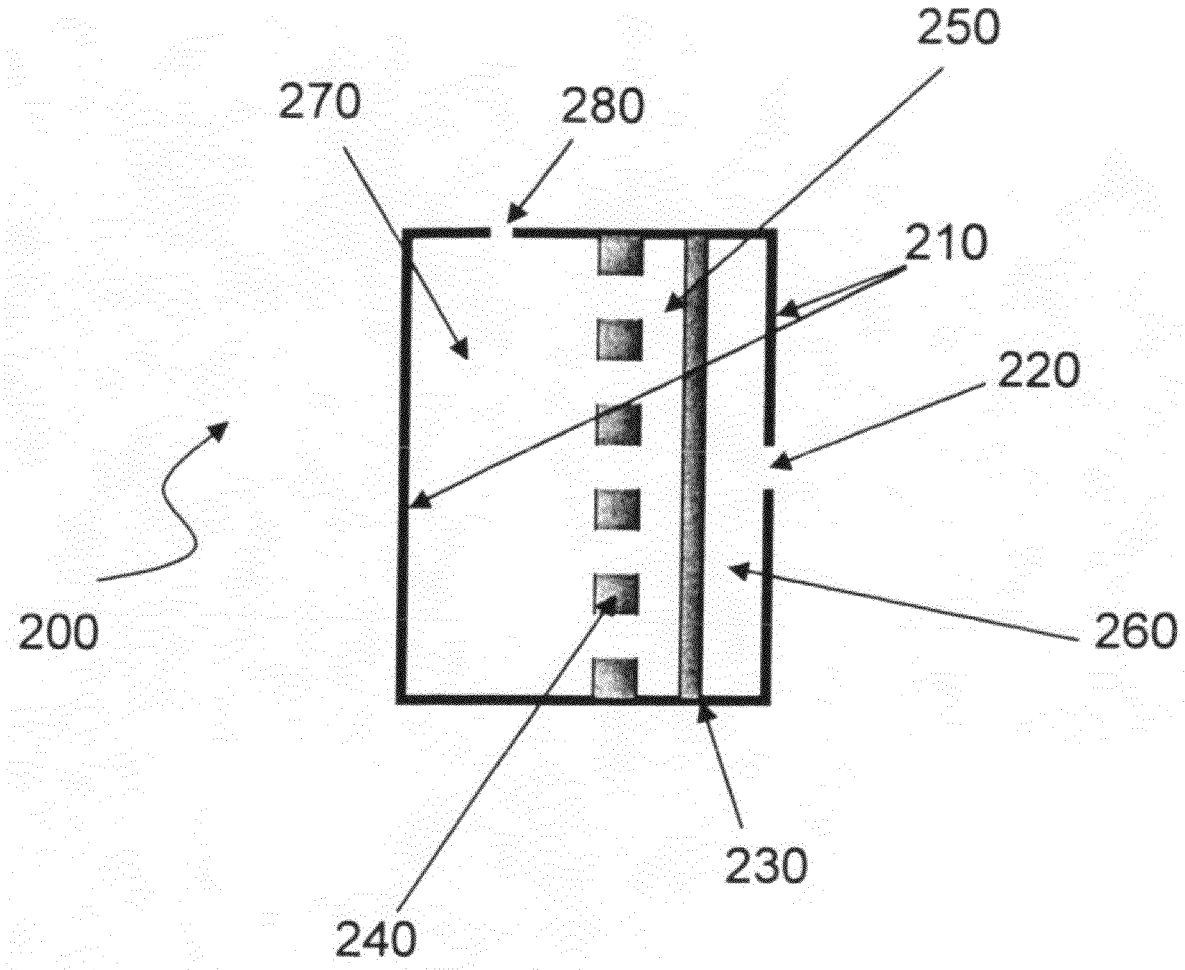
FIG. 2 is a schematic diagram of a condenser microphone construction with a vented housing.

FIGS. 1 and 2 show exemplary embodiments of vented condenser microphones 100/200. Each exemplary microphone embodiment 100/200 has an enclosed housing 110/210 defining an inner volume and having an acoustic port 120/220 at one end. A first sense structure 130/230 and second sense structure 140/240 attach to the inside of the housing 110/210, defining a gap 150/250 between the first and second sense structures 130/230 and 140/240. The first sense structure 130/230 further defines a front volume 160/260 in the interior of the housing between the first sense structure 130/230 and acoustic port 120/220. The second sense structure 140/240 further defines a back volume 170/270 between the second sense structure 140/240 and the interior of the housing 110/210 opposite the acoustic port 120/220. One of the sense structures is stationary, and the other is flexible. The flexible sense structure is a flexible electrode or diaphragm, and the stationary sense structure is a stationary electrode or backplate. The relative position of the electrode and backplate is exemplary only, and not limited to what is shown. In other exemplary embodiments, their relative positions are reversed.

FIG. 1 shows a schematic cross section view of a condenser microphone 100 having at least one diaphragm vent 180. In the exemplary embodiment shown, the vent 180 operatively connects the front volume 160 and the gap 150. FIG. 2 shows an exemplary embodiment of a condenser microphone 200 having at least one vent 280 in the housing 220. In the exemplary embodiment of FIG. 2, the vent 280 is to the back volume 270, through the microphone housing 210.

In the present invention, microphone venting is increased to equalize both static atmospheric pressure and low frequency pressure fluctuations, such as those from wind noise, road noise, and acoustic rumble, on both sides of the diaphragm. The venting may be through an acoustically sensitive diaphragm or through at least one hole adjacent to the diaphragm and contained within at least a portion of the microphone housing. In other embodiments, the hole may be contained entirely within the outermost surfaces of the microphone.

Because wind speeds are typically slower than the acoustic wave speed in air, the wavelength of a given acoustic frequency is typically longer than the length scales associated with that frequency due to pressure fluctuations resulting from air flow. Additionally, in many acoustic sensors, the only direct sensor contact to the external acoustic excitation is via a single fluidic port through the housing. Certain exemplary embodiments take advantage of these factors by locating at least one vent as close to the diaphragm as possible, and in some exemplary embodiments locating at least one vent in the diaphragm itself.

In certain embodiments the diaphragm, vent, and back volume form a mechanical filter to reduce low frequency signals generated by wind, rumble, and other acoustic noise. The diaphragms in these exemplary embodiments mechanically filter low frequencies by reducing the sensor diaphragm sensitivity to low frequencies, resulting in less diaphragm motion. Diaphragm sensitivity is influenced by multiple variables, including acoustic vent resistance ($R_1$) (also referred to as vent leakage), as well as diaphragm and back volume compliance ($C_d$ and $C_v$). Acoustic vent resistance measures vent resistance to air leakage, or, described in another way, it measures the amount of pressure change for a given air volume velocity passing through the leak. Acoustic vent resistance $R_1$ has MKS units of N-s/m$^5$. Compliance is the inverse of stiffness. Compliance measures the amount of volume deflection (volume change) for a given pressure change, and has MKS units of m$^5$/N.

Acoustic vent resistance and compliance determine a microphone's low frequency response. Acoustic vent resistance and diaphragm compliance values can be changed by varying one or more of the mechanical properties, geometry, or construction of the microphone housing or components. They may be chosen in any combination by the designer to achieve the desired acoustic response. For example, they determine the microphone 3-dB cutoff frequency ($f_c$), also known as the corner frequency. The cutoff frequency is calculated using the equation below.

$$f_c \approx \frac{1}{2\pi R_l(C_d + C_v)}$$

As shown by this equation, the cutoff frequency changes with acoustic vent resistance ($R_1$) and/or compliance ($C_d$ and/or $C_v$).

For audio applications where the acoustic sensor may be exposed to noise, road noise and acoustic rumble, it may be desirable to choose component values resulting in a cutoff frequency between approximately 100 and 350 Hz. Choosing a cutoff frequency between approximately 100 and 350 Hz reduces diaphragm response to wind noise, road noise and acoustic rumble at dominant lower frequencies. In one embodiment, the cutoff frequency is one of the following frequencies: 100, 105, 110, 115, 120, 125, 130, 135, 140, 145, 150, 155, 160, 165, 170, 175, 180, 185, 190, 195, 200, 205, 210, 215, 230, 235, 240, 250, 260, 270 280, 290, 300, 310, 320, 330, 340, and 350 Hz. In another embodiment, the cutoff frequency is between 100 and 120, 120 and 140, 140 and 160, 160 and 180, 180 and 220, 220 and 260, 260 and 320, or 320 and 350 Hz. In yet another embodiment, the cutoff frequency is above 350 Hz. In still another embodiment, the cutoff frequency is in the ultrasonic frequency range.

Figure 3:
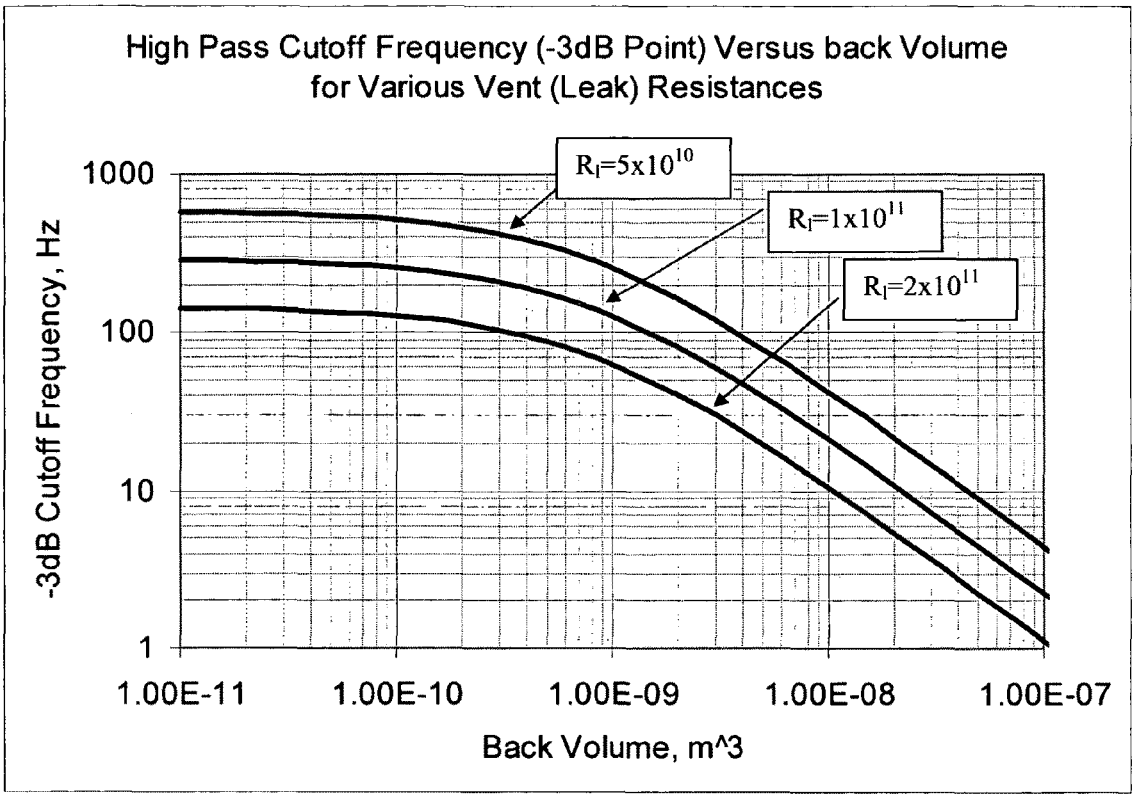
FIG. 3 illustrates the effect of back volume size on cutoff frequency at various acoustic vent resistances for a given diaphragm compliance.
Figure 4:
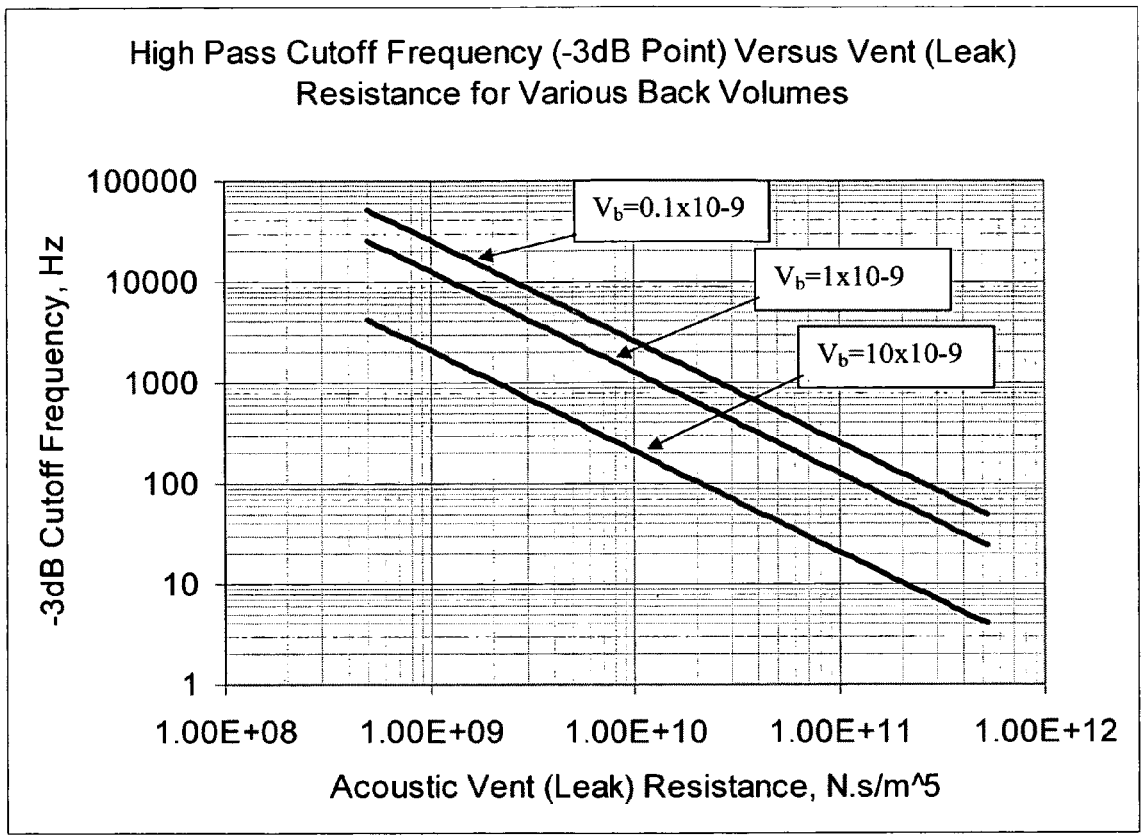
FIG. 4 illustrates the effect of acoustic vent resistance on cutoff frequency at various back volumes for a given diaphragm compliance.
Figure 5:
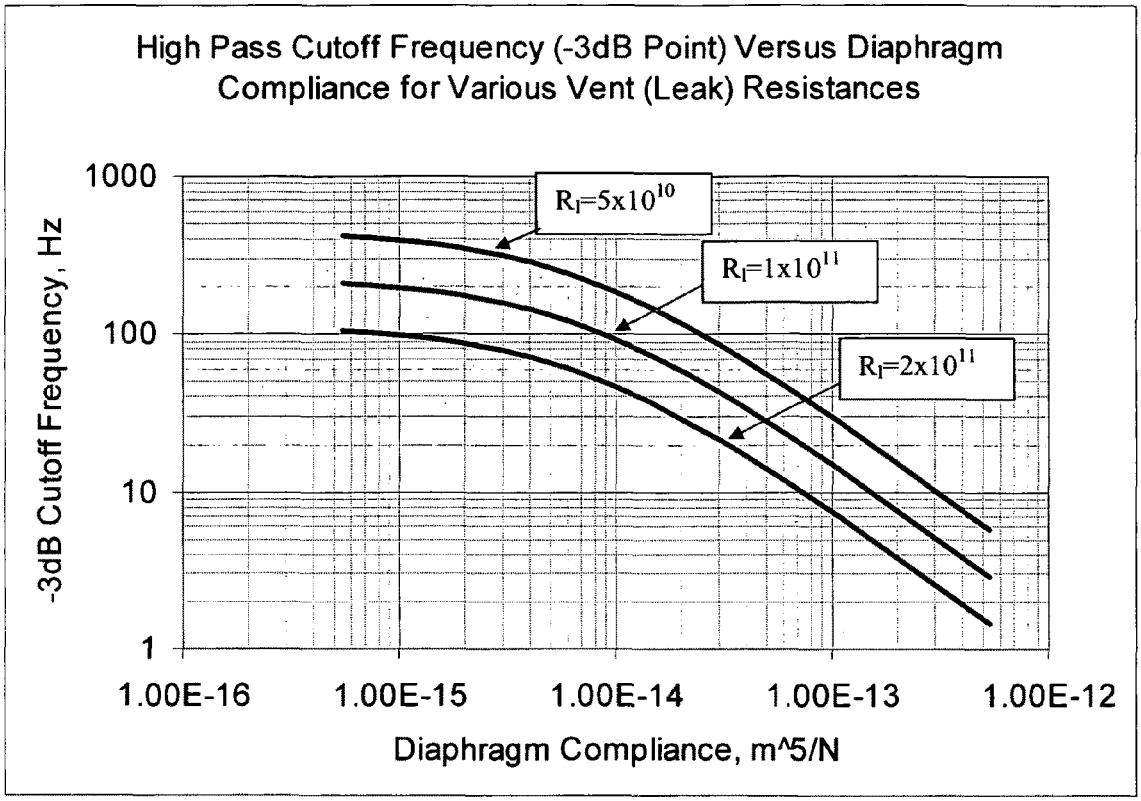
FIG. 5 illustrates the effect of diaphragm compliance on cutoff frequency at various acoustic vent resistances for a given back volume size.

FIGS. 3-5 illustrate the relationship between the cutoff frequency and $R_1$, $C_d$, and $C_v$. FIG. 3 illustrates the effect of back volume size on cutoff frequency at various vent resistances in N-s/m$^5$ for a given diaphragm compliance. As shown in FIG. 3, the cutoff frequency is inversely related to back volume. As back volume increases, cutoff frequency decreases. Conversely, as back volume decreases, cutoff frequency increases. For ultrasonic applications, it may be desirable to choose variables resulting in a corner frequency above the audio frequency band. Ultrasonic sensors, for example, may have a large leak (small $R_1$) in order to achieve a high cutoff frequency in the ultrasonic range. FIG. 3 also shows that for a given back volume, cutoff frequency is also inversely related to acoustic vent resistance.

FIG. 4 illustrates the effect of acoustic vent resistance on cutoff frequency at various back volumes in m$^3$ for a given diaphragm compliance. As shown in FIG. 4, the cutoff frequency is inversely related to acoustic vent resistance. As acoustic vent resistance increases, the cutoff frequency decreases, and as acoustic vent resistance decreases, the cutoff frequency increases. FIG. 4 also shows that cutoff frequency is inversely related to back volume.

FIG. 5 illustrates the effect of diaphragm compliance on cutoff frequency at various vent resistances in N-s/m$^5$ for a given back volume size. As shown in FIG. 5, cutoff frequency is inversely related to diaphragm compliance. As diaphragm compliance increases, cutoff frequency decreases. As compliance decreases, cutoff frequency increases. FIG. 5 also shows that for a given compliance, cutoff frequency is inversely related to acoustic vent resistance.

Figure 6:
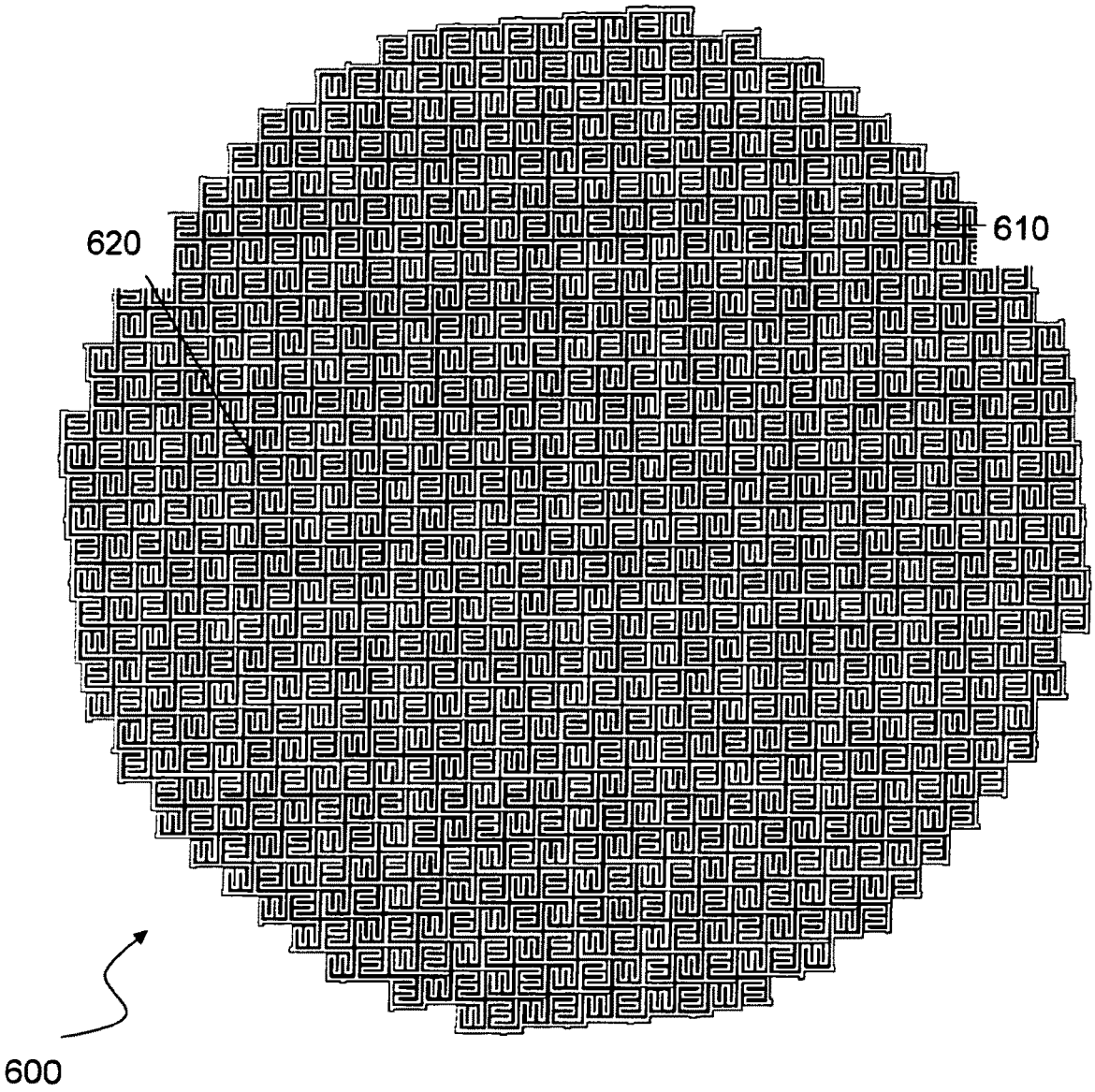
FIG. 6 illustrates an exemplary embodiment of a venting pattern through a flexible diaphragm in accordance with the present invention.
Figure 7:
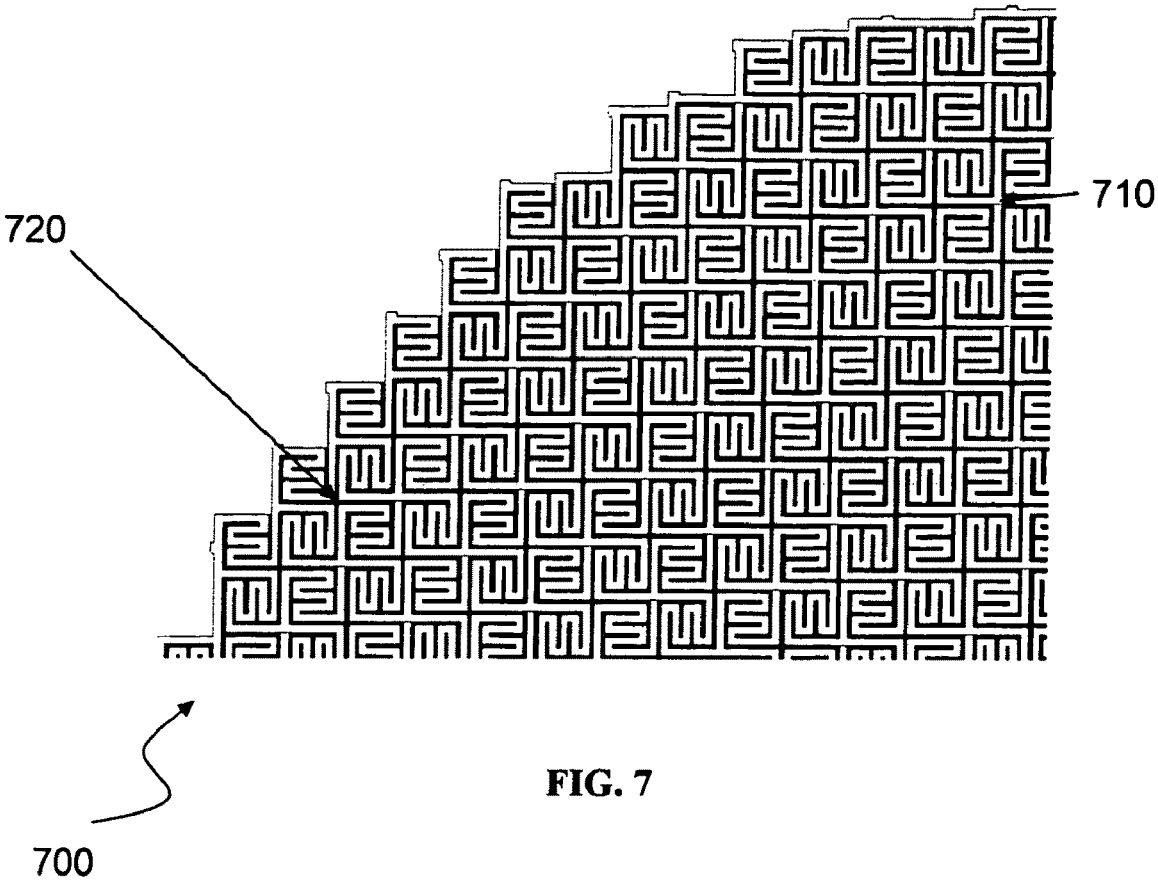
FIG. 7 is a close-up view of a portion of the exemplary embodiment in FIG. 6.

One way to change the values of cutoff frequency, compliance, and/or acoustic vent resistance is to change the diaphragm vent pattern. FIGS. 6 and 7 show an exemplary embodiment of a flexible diaphragm vent pattern 600/700. FIG. 7 is a close up view of a section of FIG. 6. The light areas of FIGS. 6 and 7 represent diaphragm material 610/710, while the dark areas in the figure represent diaphragm vents 620/720. The vents 620/720 allow air to flow through the diaphragm 610/710. In the exemplary embodiment shown, the vent 620/720 configuration reduces the response of the diaphragm 610/710 to low frequency pressure fluctuations. This may be accomplished by removing material from the diaphragm 610/710 to create one or more holes such that the at least one hole connects the air in the front volume (not shown) to the air in the gap (not shown). The vent 620/720 may comprise a single hole, or an array of holes. The holes may be circular, rectangular or any other geometry. Alternately, the vent 620/720 may penetrate the internal surfaces of a sense structure (not shown) such that it connects the air in the front volume of the housing (not shown) to the air in the back volume of the housing (not shown). Alternately, the vent 620/720 may connect the air outside the housing to the air in the back volume. In certain embodiments, the back volume is made small enough to increase the high-pass corner frequency of the vent 620/720 to accomplish low-frequency rolloff.

Figure 8:
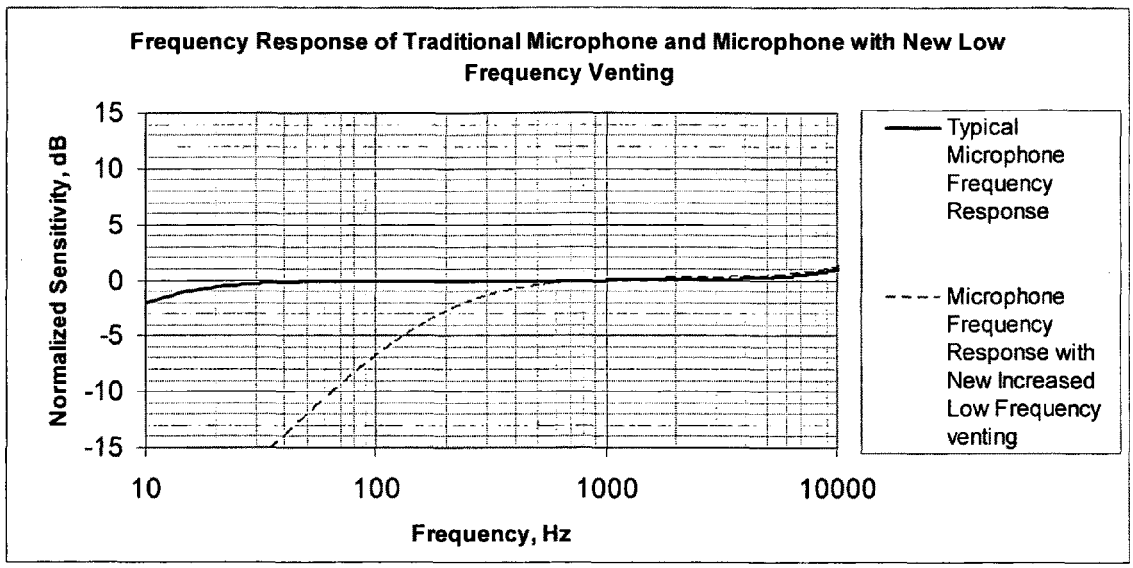
FIG. 8 illustrates the conceptual difference in frequency response of a microphone using traditional pressure equalization venting and the new venting.
Figure 9:
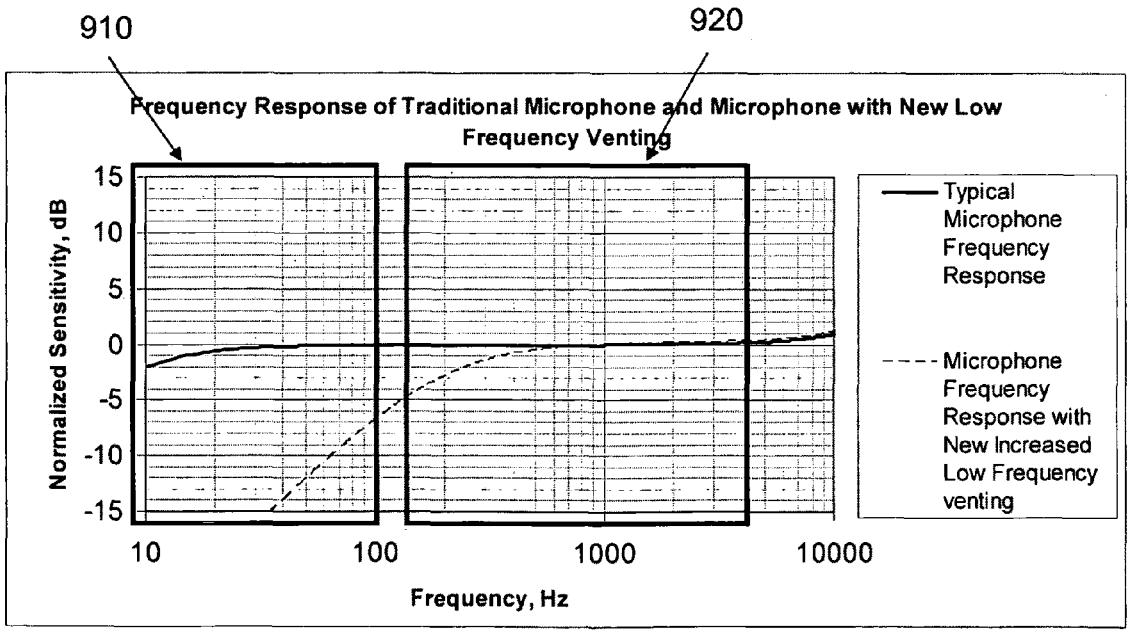
FIG. 9 illustrates how the new venting concept can reduce wind, rumble and low frequency noise pickup without strongly affecting voice communication.

FIGS. 8 and 9 show the effects of diaphragm venting on frequency response. These figures show how venting through a diaphragm or its support structure alters the frequency response of the diaphragm in the audio band. In the embodiments shown in these figures, as diaphragm venting increases, the diaphragm preferentially selects frequencies important to voice communication, and preferentially rejects frequencies predominantly present in wind, road, rumble, and low frequency noise.

FIG. 9 breaks out the frequency regions into two regions. The first frequency region 910 is the region with mostly wind, rumble, and low-frequency noise. The second frequency region 920 is the frequency region important to speech. The venting patterns of the exemplary embodiment shown mechanically reduce the acoustic sensitivity of the flexible diaphragm in the frequency range where wind, rumble and low frequency noise are strongest, without significantly reducing microphone sensitivity in frequency regions important for voice communication.

Figure 10:
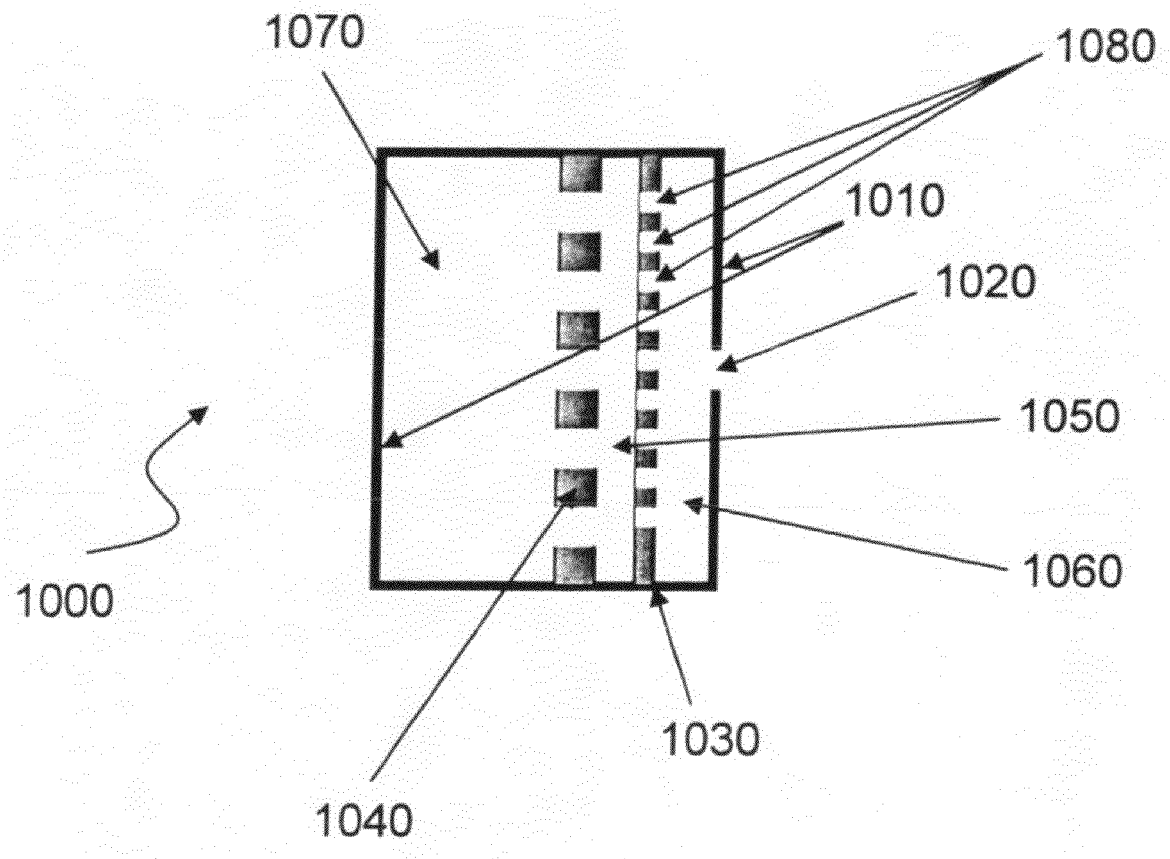
FIG. 10 is schematic diagram of an exemplary embodiment of a condenser microphone with venting through a diaphragm in accordance with the present invention.

FIG. 10 is a schematic diagram of an exemplary embodiment of a condenser microphone 1000 with at least one vent 1080. The first sense structure 1030 is a flexible electrode (diaphragm), and the second sense structure 1040 is a stationary electrode (backplate). The relative position of the first and second sense structures is 1030/1040 is exemplary only, and not limited to what is shown. In other embodiments, the relative positions of the first and second sense structures 1030/1040 are reversed. In the embodiment shown in FIG. 10, at least one vent 1080 in the diaphragm 1030 allows the air in the front volume 1060 to equalize with the air inside the gap 1050. The vent 1080 alters the acoustic compliance of the diaphragm 1030 and forms an acoustic leak resistance between the front volume 1060 and the gap 1050. The vent 1080 leak resistance and acoustic compliances of the diaphragm 1030 and back volume 1070 impact cutoff frequency in accordance with the equation discussed above.

Figure 11:
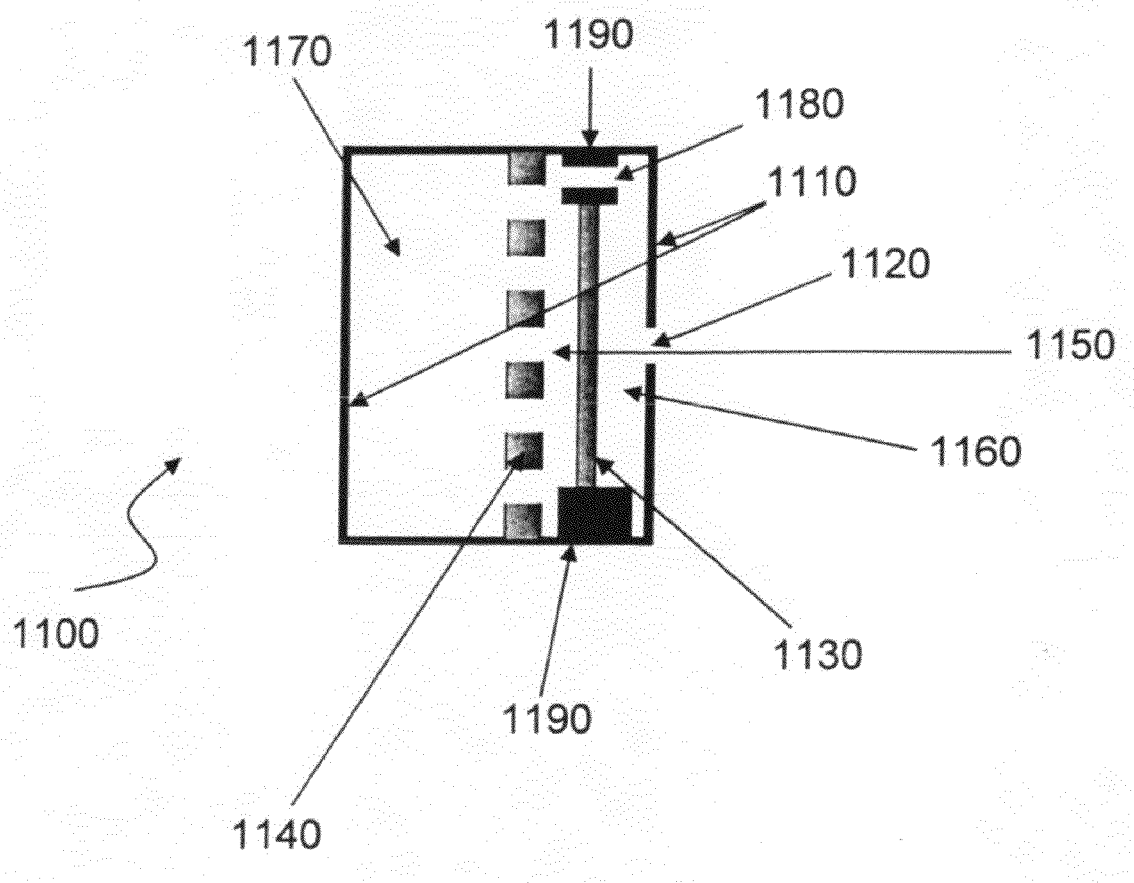
FIG. 11 is a schematic diagram of an embodiment of a condenser microphone with a vent between the front volume and the gap in accordance with the present invention.

FIG. 11 is a schematic diagram of an exemplary embodiment of a condenser microphone 1100 with a vent 1180 operatively connecting the front volume 1160 and the gap 1150. The first sense structure 1130 is a flexible electrode (diaphragm), and the second sense structure 1140 is a stationary electrode (backplate). The relative position of the first and second sense structures 1130/1140 is exemplary only, and not limited to what is shown. In other embodiments, their relative positions are reversed. In the embodiment shown, rather than having the vent 1180 in the diaphragm 1130, the vent 1180 is in a support structure 1190 attached to the housing 1110. In this embodiment, the diaphragm 1130 attaches to the support structure 1190. The external surface of the vent 1180 is adjacent to the acoustically excited side of the diaphragm 1130, which is internal to the microphone 1100. This arrangement is exemplary only, and not limited to what is shown.

Figure 12:
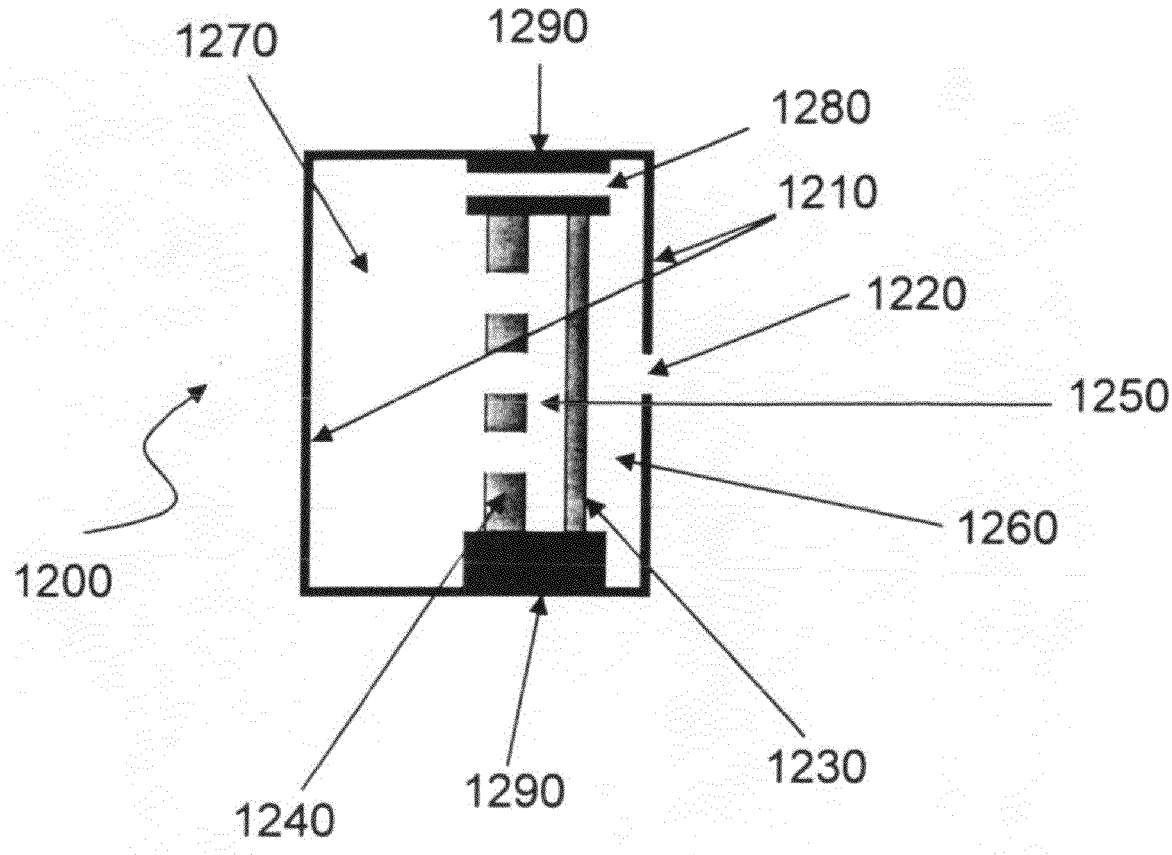
FIG. 12 illustrates an exemplary embodiment of a condenser microphone with a vent between the front volume and the back volume in accordance with the present invention.

FIG. 12 illustrates an exemplary embodiment of a vented microphone 1200 with the vent 1280 adjacent to a diaphragm. In the embodiment shown, the first sense structure 1230 is the flexible electrode (diaphragm), and the second sense structure 1240 is a stationary electrode (backplate). The relative position of the first and second sense structures 1230/1240 are exemplary only, and not limited to what is shown. In other embodiments, for example, their relative positions are reversed. In the embodiment shown in FIG. 12, the vent 1280 connects the front and back volumes 1260/1270 of the condenser microphone 1200. The vent 1280 is in the stationary support structure 1290 rather than the diaphragm 1230. The stationary support structure 1290 supports both the diaphragm 1230 and the stationary electrode 1240. This arrangement is exemplary only, and not limited to what is shown.

Figure 13A:
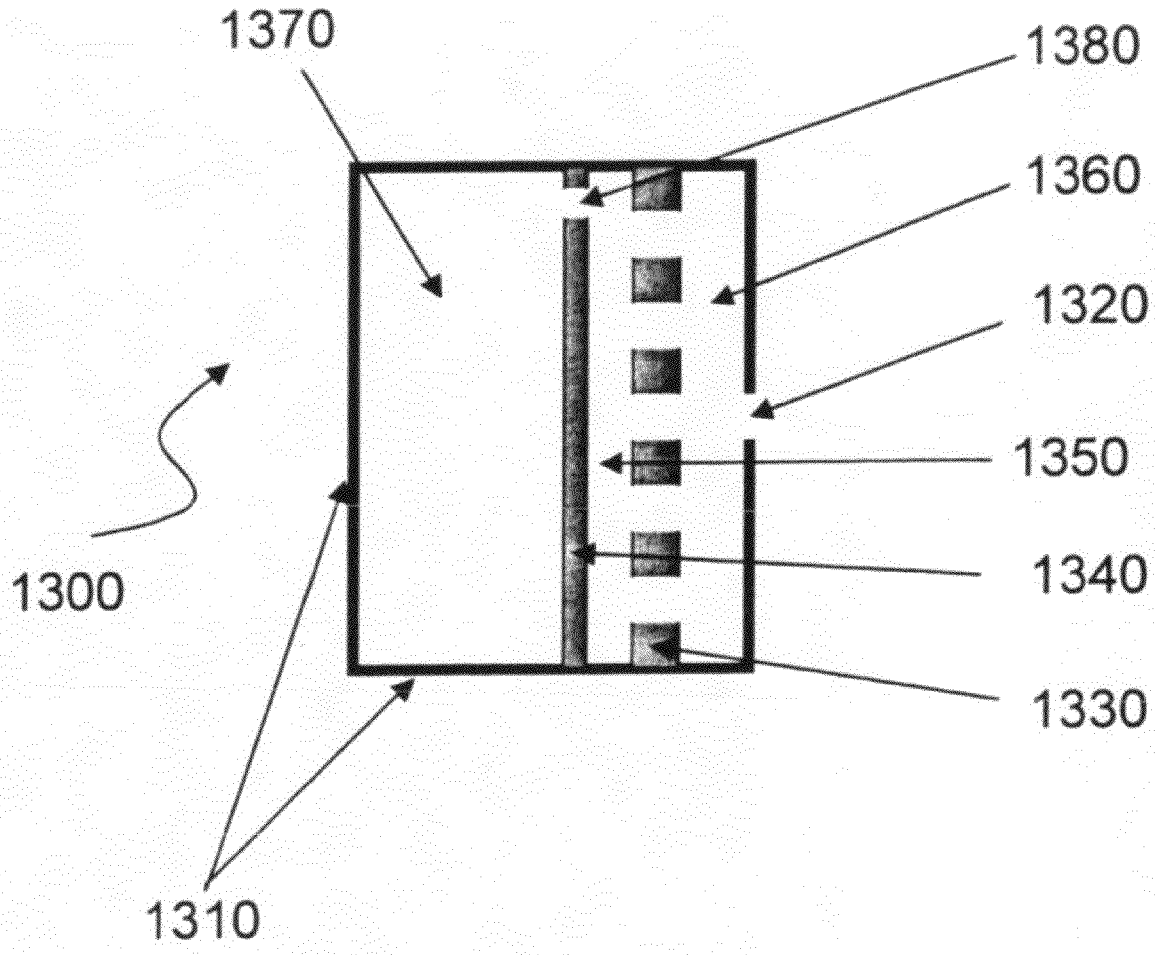
FIGS. 13A and 13B illustrate exemplary embodiments of a condenser microphone with a stationary electrode adjacent to the front volume and a diaphragm adjacent to the back volume in accordance with the present invention.
Figure 13B:
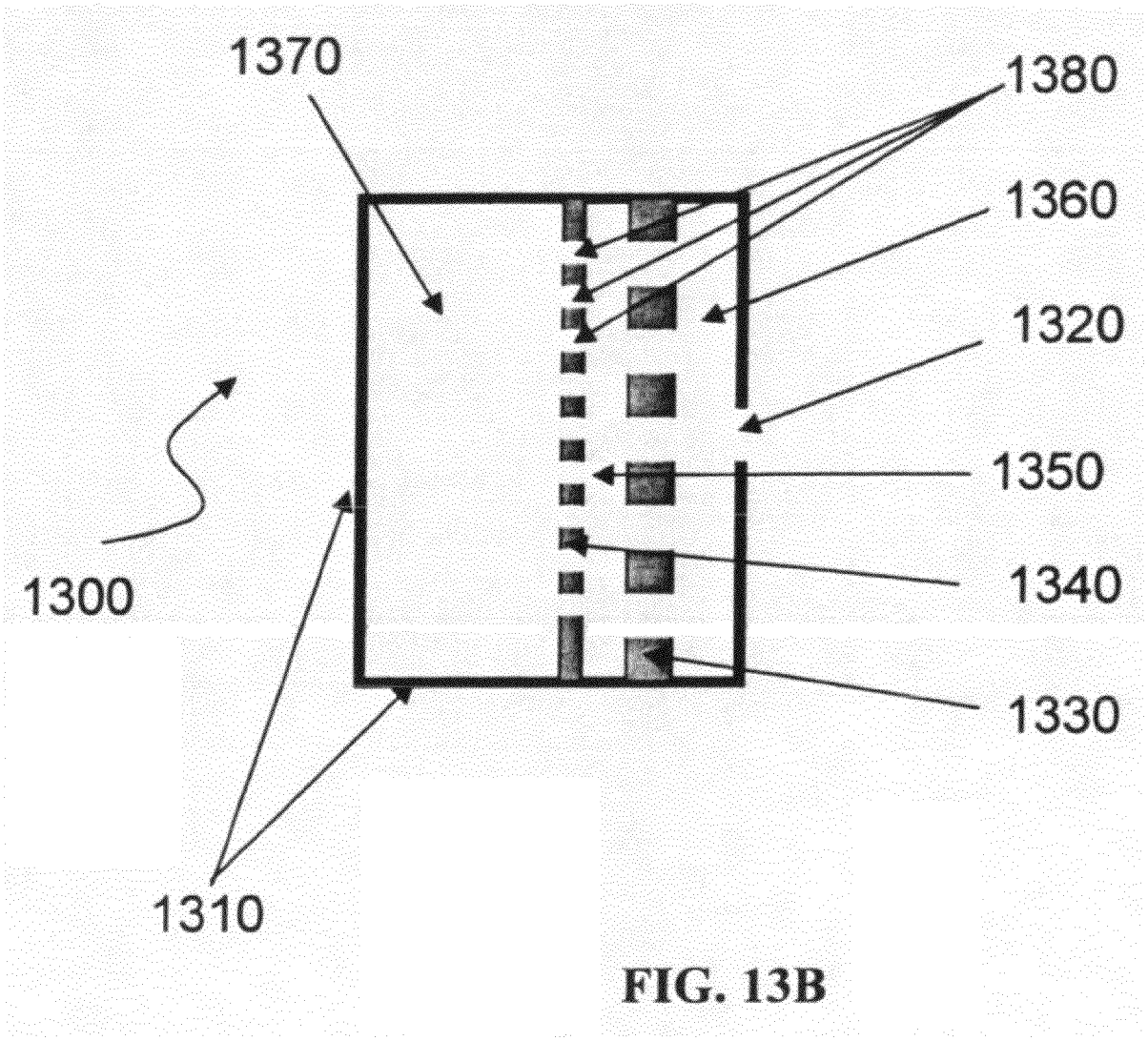

FIGS. 13A and 13B illustrate exemplary embodiments of a condenser microphone 1300 having a first sense structure 1330 configured as a stationary electrode adjacent to the front volume 1360, and a second sense structure 1340 configured as a diaphragm adjacent to the back volume 1370. At least one diaphragm vent 1380 connects the air in the gap 1350 to the air in the back volume 1370. The relative position of the first and second sense structures 1330/1340 is exemplary only, and not limited to what is shown. In other exemplary embodiments, their relative positions are reversed.

Figure 14A:
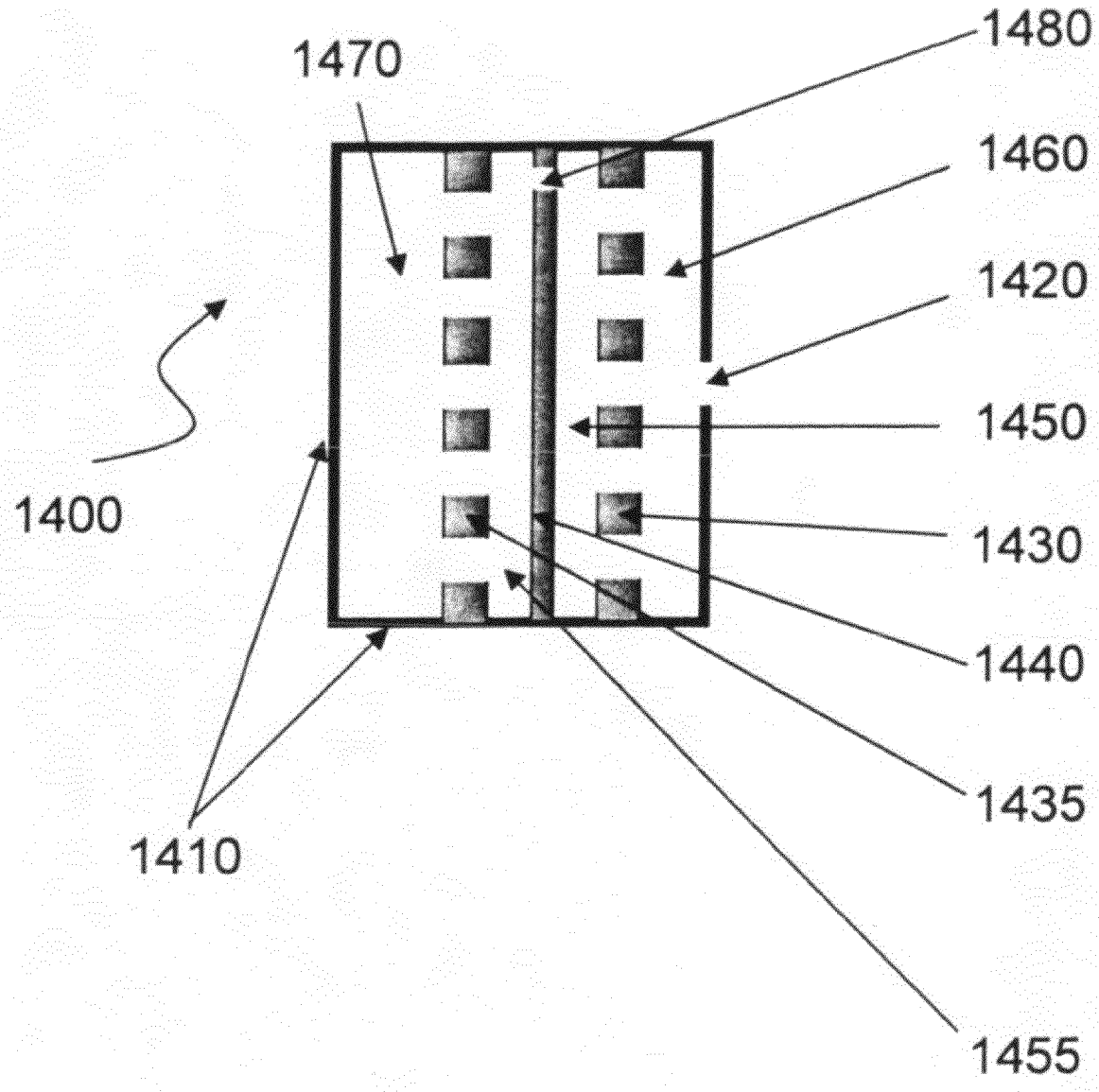
FIGS. 14A and 14B illustrate exemplary embodiments of a condenser microphone having three sense structures in accordance with the present invention.
Figure 14B:
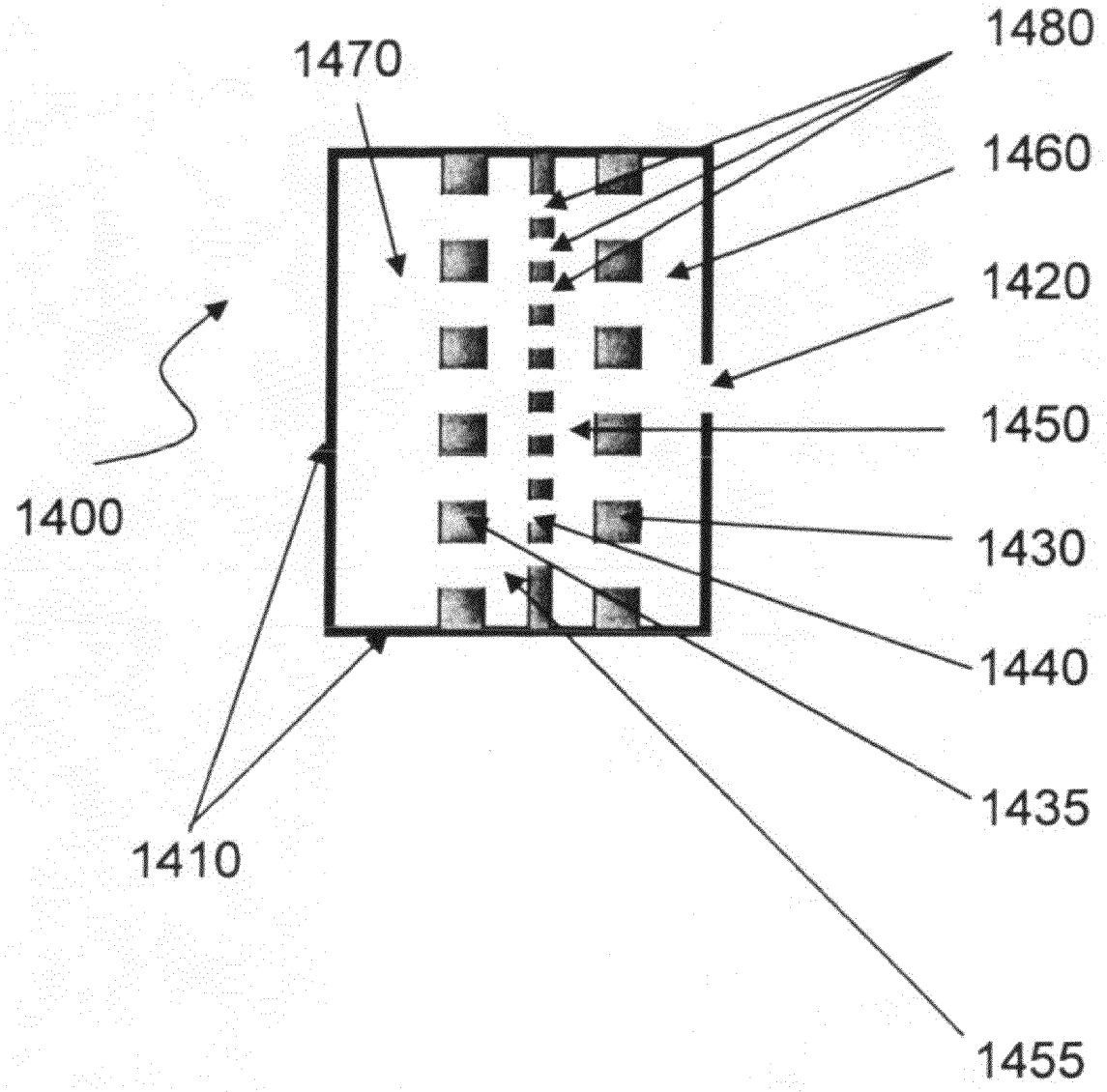

FIGS. 14A and 14B illustrate exemplary embodiments of a condenser microphone 1400 having three sense structures. In the embodiments shown, the microphone 1400 has a first sense structure 1430 configured as a back plate adjacent to the front volume 1460, and a second sense structure 1435 configured as back plate adjacent to the back volume 1470. The two back plates form a first gap 1450 and a second gap 1455. A third sense structure 1440 configured as a diaphragm is located between the first and second gaps 1450/1455. In these exemplary embodiments, the diaphragm 1440 has at least one vent 1480 operatively connecting the air in the first gap 1450 with the air in the second gap 1455. The relative positions of the sense structures 1430/1435/1440 are exemplary only, and not limited to what is shown.

Figure 15:
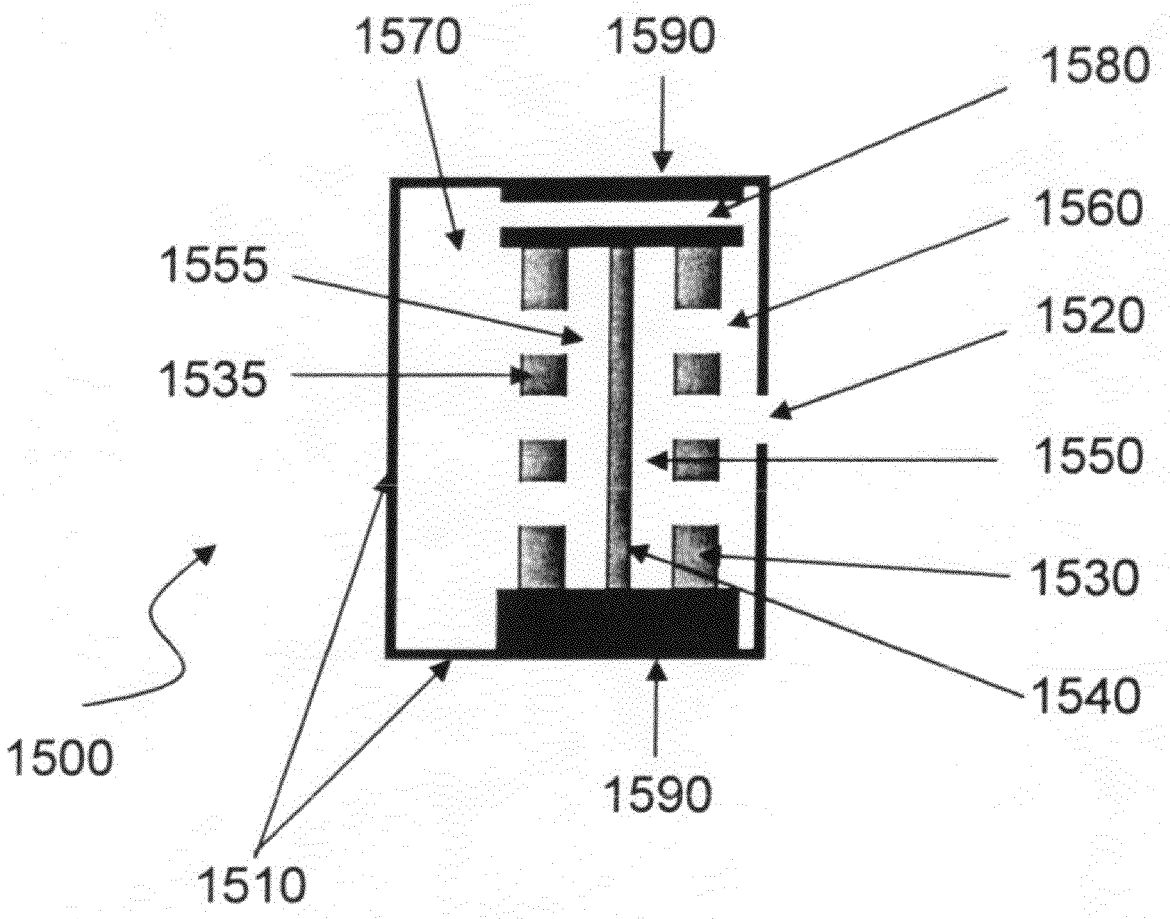
FIG. 15 illustrates an exemplary embodiment of a condenser microphone having three sense structures and a vent between the front volume and back volume in accordance with the present invention.

FIG. 15 illustrates an exemplary embodiment of a condenser microphone 1500 having three sense structures 1530/1535/1540 with at least one vent 1580 adjacent to the sense structures. In the embodiment shown, a first sense structure 1530 is configured as a back plate adjacent to the front volume 1560, and a second sense structure 1535 is configured as a back plate adjacent to the back volume 1570. The two back plates form a first gap 1550 and a second gap 1555. A third sense structure 1540 is configured as a diaphragm and is located between the first and second gaps 1550/1555. In this exemplary embodiment, the at least one vent 1580 operatively connects the air in the front volume 1560 with the air in the back volume 1570. In the embodiment shown, the at least one vent 1580 is in a stationary support structure 1590, but need not be. The stationary support structure 1590 supports the diaphragm 1540 and the stationary electrodes 1530/1535. The relative positions of the sense structures 1530/1535/1540 are exemplary only, and not limited to what is shown.

It will be apparent to those skilled in the art that various modifications and variations can be made in the wind immune microphone of the present invention without departing form the spirit or scope of the invention. Thus, it is intended that the present invention cover the modifications and variations of this invention provided they come within the scope of the appended claims and their equivalents.

What is claimed is:

1. An acoustic device, comprising:

an enclosed housing defining an inner volume and having a front and a back;

an acoustic port penetrating the front of the housing;

a first and second sense structure attached to the inside of the housing and defining a gap between the first and second sense structures;

a front volume defined by the portion of the inner volume between the first sense structure and the front of the housing;

a back volume defined by the portion of the inner volume between the second sense structure and the back of the housing; and at least one vent in the first sense structure operatively connecting the front volume and the gap, wherein the acoustic device has a cutoff frequency above approximately 100 Hz.

2. An acoustic device, comprising:

an enclosed housing defining an inner volume and having a front and a back;

an acoustic port penetrating the front of the housing;

a support structure attached to the inside of the housing;

a first sense structure attached to the support structure;

a second sense structure attached to the inside of the housing, the first and second sense structures defining a gap between the first and second sense structures;

a front volume defined by the portion of the inner volume between the first sense structure and the front of the housing;

a back volume defined by the portion of the inner volume between the second sense structure and the back of the housing; and at least one vent in the support structure, the at least one vent operatively connecting the front volume and the gap, wherein the acoustic device has a cutoff frequency above approximately 100 Hz.

3. An acoustic device, comprising:

an enclosed housing defining an inner volume and having a front and a back;

an acoustic port penetrating the front of the housing;

a support structure attached to the inside of the housing;

a first and second sense structure attached to the support structure and defining a gap between the first and second sense structures;

a front volume defined by the portion of the inner volume between the first sense structure and the front of the housing;

a back volume defined by the portion of the inner volume between the second sense structure and the back of the housing; and at least one vent in the support structure, the at least one vent operatively connecting the front and back volumes, wherein the acoustic device has a cutoff frequency above approximately 100 Hz.

4. The acoustic device of claim 3, further comprising:

a third sensing structure, the third sensing structure and the second sensing structure defining a second gap between the second and third sense structures, wherein the at least one vent operatively connects the front and back volumes.

5. An acoustic device, comprising:

an enclosed housing defining an inner volume and having a front and a back;

an acoustic port penetrating the front of the housing;

a first and second sense structure attached to the inside of the housing and defining a gap between the first and second sense structures;

a front volume defined by the portion of the inner volume between the first sense structure and the front of the housing;

a back volume defined by the portion of the inner volume between the second sense structure and the back of the housing; and at least one vent in the second sense structure operatively connecting the back volume and the gap, wherein the acoustic device has a cut off frequency above approximately 100 Hz.

6. The acoustic device of claim 5, further comprising:

a third sensing structure, the third sensing structure and the second sensing structure defining a second gap between the second and third sense structures, wherein the at least one vent operatively connects the first and second gaps.

7. The acoustic device as in one of claims 1-4, wherein the acoustic device is a condenser microphone.

8. The acoustic device as in one of claims 1-4, wherein the acoustic device is a MEMS device.

9. The acoustic device as in one of claims 1-4, wherein at least one sense structure is flexible.

10. The acoustic device as in one of claims 1-4, wherein the acoustic device has a diaphragm compliance of approximately $1*10^{-15}m^3/Pa$, a back volume less than approximately 5 $mm^3$, and a vent resistance less than approximately $5*10^{10}N\text{-}s/m^5$.

11. The acoustic device as in one of claims 1-4, wherein the acoustic device has a diaphragm compliance of approximately $1*10^{-15}m^3/Pa$, a back volume less than 2 $mm^3$, and a vent resistance less than approximately $1.1*10^{11}N\text{-}s/m^5$.

12. The acoustic device as in one of claims 1-4, wherein the acoustic device has a diaphragm compliance of approximately $0.6*10^{-15}m^3/Pa$, a back volume less than 2 $mm^3$, and a vent resistance less than approximately $1.1*10^{11}N\text{-}s/m^5$.

13. The acoustic device as in one of claims 1-4, wherein the acoustic device has a diaphragm compliance of approximately $0.6*10^{-15}m^3/Pa$, a back volume less than 0.4 $mm^3$, and a vent resistance less than approximately $5*10^{11}N\text{-}s/m^5$.

14. The acoustic device as in one of claims 1-4, wherein the acoustic device has a vent resistance, $R_1$ less than approximately $(628*(C_d+V/(142000))^{-1}$, where $C_d$ is the diaphragm compliance in $m^3/Pa$, V is the back volume in $m^3$, and $R_1$ is the vent resistance in $N\text{-}s/m^5$.

15. The acoustic device as in one of claims 1-4, wherein the gap includes only an air gap.

16. A method of forming an acoustic device, comprising the steps of:

forming an enclosed housing defining an inner volume and having a front and a back;

forming an acoustic port penetrating the front of the housing;

attaching a diaphragm having a compliance $C_d$ to the inside of the housing and separated a distance from the back of the housing, the diaphragm dividing the inner volume into a front volume and a back volume, the back volume having a compliance $C_v$;

forming at least one vent in the diaphragm, the vent having an acoustic resistance $R_1$; and setting $C_d$, $C_v$ and $R_1$ to non-zero values such that the acoustic device has a cutoff frequency $f_c$ of approximately 100 Hertz or greater, with $f_c$ defined by the equation $$f_c \approx \frac{1}{2\pi R_l(C_d + C_v)}.$$

17. A method of forming an acoustic device, comprising the steps of:

forming an enclosed housing defining an inner volume and having a front and a back;

forming an acoustic port penetrating the front of the housing;

attaching a support structure to the inside of the housing;

attaching a diaphragm having a compliance $C_d$ to the support structure and separated a distance from the back of the housing, the diaphragm dividing the inner volume into a front volume and a back volume, the back volume having a compliance $C_v$;

forming at least one vent connecting the front volume to the back volume, the vent having an acoustic resistance $R_1$; and setting $C_d$, $C_v$ and $R_1$ to non-zero values such that the acoustic device has a cutoff frequency $f_c$ of approximately 100 Hertz or greater, with $f_c$ defined by the equation $$f_c \approx \frac{1}{2\pi R_l(C_d + C_v)}.$$

* * * * *